US010825286B2

(12) United States Patent
Gallagher et al.

(10) Patent No.: US 10,825,286 B2
(45) Date of Patent: Nov. 3, 2020

(54) GAMING MACHINE CABINET WITH MULTIPLE PANEL ACCESS STRUCTURE

(71) Applicant: Everi Games, Inc., Austin, TX (US)

(72) Inventors: Craig Steven Gallagher, Austin, TX (US); Peter A. Phillips, Jr., Austin, TX (US); Travis B. Bussey, Austin, TX (US)

(73) Assignee: Everi Games, Inc., Austin, TX (US)

( * ) Notice: Subject to any disclaimer, the term of this patent is extended or adjusted under 35 U.S.C. 154(b) by 104 days.

(21) Appl. No.: 16/115,537

(22) Filed: Aug. 28, 2018

(65) Prior Publication Data

US 2019/0102983 A1 Apr. 4, 2019

Related U.S. Application Data

(60) Provisional application No. 62/566,411, filed on Sep. 30, 2017.

(51) Int. Cl.
*G07F 17/32* (2006.01)

(52) U.S. Cl.
CPC ..... *G07F 17/3216* (2013.01); *G07F 17/3202* (2013.01); *G07F 17/3211* (2013.01)

(58) Field of Classification Search
CPC ..... G07F 17/3216; G07F 17/3202; G07F 17/3211
See application file for complete search history.

(56) References Cited

U.S. PATENT DOCUMENTS 8,366,555 B2 * 2/2013 McGahn ..... G07F 17/32 463/29
9,697,679 B2 * 7/2017 Ho ..... G07F 17/3216
2006/0205504 A1 * 9/2006 Okada ..... G07F 17/32 463/36
2006/0287112 A1 * 12/2006 Mallory ..... G07F 17/32 463/46
2008/0055491 A1 * 3/2008 Gordon ..... G07F 17/3202 348/836
2008/0113796 A1 * 5/2008 Beadell ..... G07F 17/32 463/35
2010/0120530 A1 * 5/2010 Lesley ..... G07F 17/32 463/30

(Continued)

FOREIGN PATENT DOCUMENTS

GB 2388696 A * 11/2003 ..... G07F 17/32

*Primary Examiner* — Jasson H Yoo
(74) *Attorney, Agent, or Firm* — Russell D. Culbertson; The Culbertson Group, P.C.

(57) ABSTRACT

A gaming machine includes a cabinet defining an upper cabinet volume and a cabinet front opening to the upper cabinet volume. A video monitor is mounted on the gaming machine cabinet so that in an operating position, the video monitor registers with and covers an upper portion of a base area of a cabinet front opening. A panel is also mounted on the gaming machine cabinet so that in a panel operating position, the panel component registers with and covers a lower portion of the base area, that is, a portion of the base area immediately below the portion covered by the video monitor in its operating position. Assemblies are included which allow the video monitor to be moved to an open position vacating the base area of the cabinet front opening and allow the panel to traverse the vacated area to an open position for the panel.

20 Claims, 7 Drawing Sheets

(56) References Cited

U.S. PATENT DOCUMENTS

| | | | | |
|---|---|---|---|---|
| 2010/0124994 | A1* | 5/2010 | O'Keene | G07F 17/32 463/46 |
| 2016/0184716 | A1* | 6/2016 | Sprenger | A63F 13/90 463/46 |
| 2016/0343204 | A1* | 11/2016 | Maher | G07F 17/3216 |
| 2018/0053373 | A1* | 2/2018 | Goldstein | G07F 17/3213 |

* cited by examiner

GAMING MACHINE CABINET WITH MULTIPLE PANEL ACCESS STRUCTURE

CROSS-REFERENCE TO RELATED APPLICATION

Applicant claims the benefit, under 35 U.S.C. § 119(e), of U.S. Provisional Patent Application No. 62/566,411 filed Sep. 30, 2017, and entitled "Gaming Machine Cabinet with Multiple Panel Access Structure." The entire content of this provisional application is incorporated herein by this reference.

TECHNICAL FIELD OF THE INVENTION

The invention relates to gaming machine cabinets, and, more particularly, to arrangements for conveniently opening a gaming machine cabinet to provide access to the interior components. Aspects of the invention include both gaming machine cabinet structures and methods of operation.

BACKGROUND OF THE INVENTION

Gaming machines found in casinos and other gaming establishments commonly include a cabinet on which various display devices and player interface devices are mounted. The display devices may include one or more video display monitors which are operable to display game-related information and other information and to display games conducted at the gaming machine such as video reel-type games, video card games, and other types of wagering games. Player interface devices may include ticket or voucher printers, various control buttons, cash-in or ticket-in devices, and player card readers. Gaming machine cabinets define an interior volume for housing various internal components such as data processing devices and supporting equipment. While the interior components of the gaming machine must remain secured so as to prevent unauthorized access and tampering with the gaming machine, it is still necessary for the gaming machine cabinets to have access points to allow authorized personnel to access the interior volume of the cabinet for maintenance and service purposes.

Providing access to the interior volume of a gaming machine cabinet can be problematic for a number of reasons. One issue arises from the fact that gaming machines are commonly arranged on the casino floor close together side-by-side and either back-to-back with other gaming machines or against a wall. This leaves the front of the gaming machine cabinet as the only exposed portion for providing access to the interior volume when the gaming machine remains in place on the casino floor. Yet in modern gaming machines, video display monitors and other electronic devices take up a substantial portion of the front surface of the gaming machine, if not the entire front surface, leaving little or no room for access without moving the video display monitors and other electronic equipment from their operating positions on the gaming machine cabinet. Moving the video display monitors from their operating position can cause problems where such devices must remain supported by the gaming machine cabinet because repositioning the devices can leave the gaming machine in danger of tipping over.

SUMMARY OF THE INVENTION

It is an object of the invention to provide gaming machines having a cabinet access structure that provides superior access to the interior volume of the cabinet while the gaming machine remains installed in a bank of gaming machines or other arrangement in a casino or other gaming establishment. Although not limited to such applications, aspects of the present invention are particularly applicable to gaming machines having multiple large display devices such as video display monitors for displaying wagering games and information to players.

In the following disclosure and claims, relative positional terms such as upper, lower, top, bottom, side, above, below, laterally, for example, are used with reference to the orientation of the gaming machine shown in the figures unless specifically stated otherwise.

A gaming machine according to one aspect of the present invention includes a gaming machine cabinet defining an upper cabinet volume above a level of a button deck mounted on the gaming machine cabinet. The gaming machine cabinet also defines a cabinet front opening to the upper cabinet volume. A first gaming machine element, which may include a first video display monitor or some other display device, is mounted on the gaming machine cabinet so that in an operating position, the first gaming machine element registers with and covers an upper portion of a base area of the cabinet front opening. A panel component, which may include a panel having or providing access to various player interface components of the gaming machine, is also mounted on the gaming machine cabinet. The panel component is mounted on the gaming machine cabinet so that in a panel operating position, the panel component registers with and covers a lower portion of the base area, that is, a portion of the base area immediately below the portion covered by the first gaming machine element when that element is in its operating position. A gaming machine according to this aspect of the present invention further includes a first extension assembly associated with the first gaming machine element and a slide assembly associated with the panel component. The first extension assembly is connected between the first gaming machine element and the gaming machine cabinet and is operable to enable the first gaming machine element to be moved from the first element operating position to a first element open position in which the first gaming machine element remains supported by the gaming machine cabinet and is removed from the upper portion of the base area. The slide assembly is connected between the panel component and the gaming machine cabinet and is operable for, when the first gaming machine element is in the first element open position, enabling the panel component to be moved from the panel component operating position to an panel open position in which the panel component remains supported by the gaming machine cabinet. The slide assembly is configured such that in the course of movement from the panel operating position to the panel open position the panel component traverses a least some of the upper portion of the base area from which the first gaming machine element is removed when moved to the first element open position.

The combination of the first extension assembly for the first gaming machine element and the slide assembly for the panel component according to this aspect of the invention has the advantage that the gaming machine cabinet may be opened from the front of the cabinet and without having to move the gaming machine from its place on a casino floor and without interfering with player access to adjacent gaming machines. The first gaming machine element, typically a video display monitor, and the panel component both remain neatly supported by the gaming machine cabinet when they are moved to their respective open position and reside in the respective open position with the gaming machine cabinet remaining suitably balanced to avoid tipping.

In some implementations of a gaming machine according to this first aspect of the invention the first extension assembly includes a pivot arm connected at a distal end thereof to the first gaming machine element or to a bracket to which the first gaming machine element may be attached. The pivot arm has a proximal end pivotally connected to the gaming machine cabinet to facilitate rotation of the pivot arm about a pivot axis extending perpendicular to a vertical axis of the gaming machine cabinet as the first gaming machine element is moved from the first element operating position to the first element open position. In some cases the pivot axis is located within the upper cabinet volume between the cabinet front opening and a rear wall of the gaming machine cabinet. Also, the pivot arm may include an extension part at the pivot arm proximal end, and the pivoting connection to the gaming machine cabinet is in the extension part so that the pivot axis is offset from a longitudinal axis of the pivot arm at the proximal end of the pivot arm. The pivot arm may also have a structure that forms a concave shape facing forward within the upper cabinet volume when the first gaming machine element is in its operating position. These pivot offset and concave pivot arm shape contribute to a greater range of movement for the first gaming machine element.

In some implementations of a gaming machine according to the first aspect of the invention, the slide assembly may include a first side rail mounted substantially vertically on a first side of the gaming machine cabinet within the upper cabinet volume, and a second side rail mounted substantially vertically on a second side of the gaming machine cabinet within the upper cabinet volume. A carriage assembly in these implementations may be connected to both the first side rail and the second side rail for longitudinal movement with respect to each rail, and the panel component may be mounted on the carriage assembly. In some cases the carriage assembly may include a component that extends the width of the gaming machine interior volume and slidably connects at each side rail. In these cases the panel component is mounted on the transversely extending carriage assembly. In other implementations the carriage assembly includes a first side carriage slidably connected to the first side rail (that is, connected for movement with respect to the first side rail along a longitudinal axis of the rail) and a second side carriage slidably connected to the second side rail. In these cases the panel component is mounted at a first end thereof on the first side carriage and mounted at second end thereof of the second side carriage.

A gaming machine according to the first aspect of the invention may further include a second gaming machine element (which may include a second video display monitor for example) mounted on the gaming machine cabinet so that in an operating position of the second gaming machine element the device registers with and covers a crown area of the cabinet front opening located above the base area. A second extension assembly is connected between the second gaming machine element and the gaming machine cabinet, and is operable to enable the second gaming machine element to be moved from its operating position to a second element open position. In the second element open position the second gaming machine element remains supported by the gaming machine cabinet and is removed from the crown area. The second extension assembly may include first and second side scissor mechanisms which are laterally spaced apart along the width of the gaming machine cabinet about a cabinet center vertical axis. Each of these scissor mechanisms is connected at a distal end thereof to the second gaming machine element (or a bracket to which the element may be connected) and connected at a proximal end thereof to the gaming machine cabinet within the cabinet upper volume.

Another aspect of the invention includes methods for providing access to a gaming machine cabinet where the cabinet defines both an upper cabinet volume (above a level of the gaming machine button deck) and a cabinet front opening to the upper cabinet volume. Methods according to this aspect of the invention may include moving the first gaming machine element described above from a first element operating position to a first element open position, both positions being described above in connection with the apparatus. When the first gaming machine element is in its open position, methods according to this aspect of the invention include moving the panel component described above in connection with the apparatus from the panel component operating position to the panel open position in which the panel component remains supported by the gaming machine cabinet, both positions being described above in connection with the apparatus. When the first gaming machine element and panel component are in their respective open position, the lower portion of the base area and at least some of the upper portion of the base area is exposed for service or maintenance.

In methods according to this second aspect of the invention moving the first gaming machine element from the first element operating position to the first element open position may include pivoting the first gaming machine element on the pivot arm described above in connection with the apparatus. Also, moving the panel component from the panel component operating position to the panel open position may include sliding the panel component along the first and second side rails as described above.

These and other advantages and features of the invention will be apparent from the following description of representative embodiments, considered along with the accompanying drawings.

DESCRIPTION OF REPRESENTATIVE EMBODIMENTS

Figure 1:
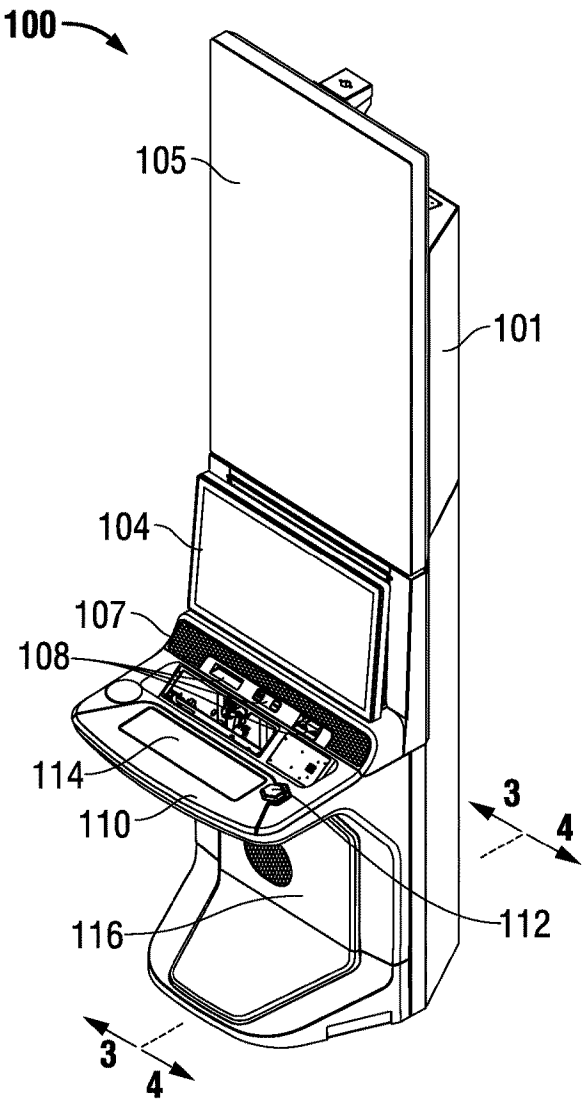
FIG. 1 is a view in perspective of a gaming machine according to aspects of the present invention.

Referring to FIG. 1, an example gaming machine 100 includes a gaming machine cabinet 101 on which is mounted a first video display monitor 104 and a second video display monitor 105. Gaming machine 100 further includes a panel 107 containing or providing access to several player interface devices 108 immediately below first video display monitor 104. A button deck 110 is also mounted on gaming machine cabinet 101 protruding from a front of the cabinet immediately below panel 107. Various player interface devices such as a physical button 112 and touchscreen control panel 114 are located on the illustrated button deck 110. One or more removable or openable panels 116 may be positioned at the front of the gaming machine cabinet below button deck 110.

Figure 2:
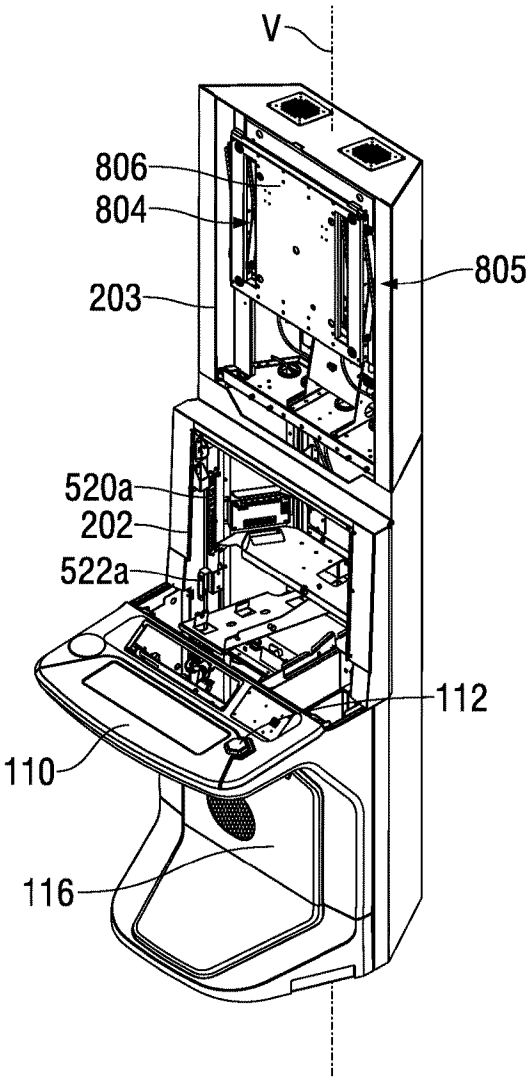
FIG. 2 is a view in perspective of the gaming machine shown in FIG. 1 but with front components removed from the gaming machine cabinet to expose the cabinet upper interior volume and cabinet front opening.
Figure 3:
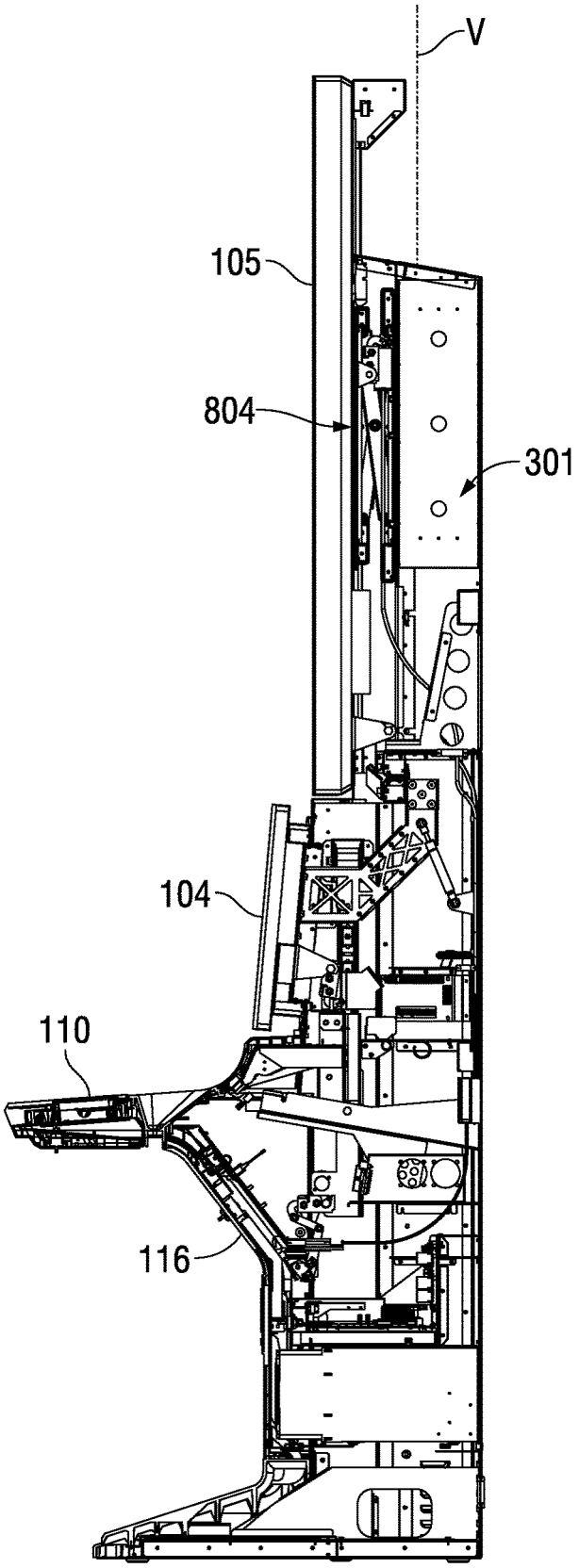
FIG. 3 is a section view in the direction of arrows 3-3 in FIG. 1.

Referring to FIGS. 2 and 3, gaming machine cabinet 101 defines an upper cabinet volume shown by arrow 301 in FIG. 3 above the level of the button deck 110. Gaming machine cabinet 101 also includes a cabinet front opening (exposed in FIG. 2) to the upper cabinet volume 301. In this particular example, and referring particularly to FIG. 2, the cabinet front opening is divided into two areas including a base area defined by opening 202 and a crown area defined by opening 203. Referring to the section view of FIG. 3, first video monitor 104 is mounted in an upper portion of the base area of the cabinet front opening while panel 107 is mounted in a lower portion of the base area.

Figure 4:
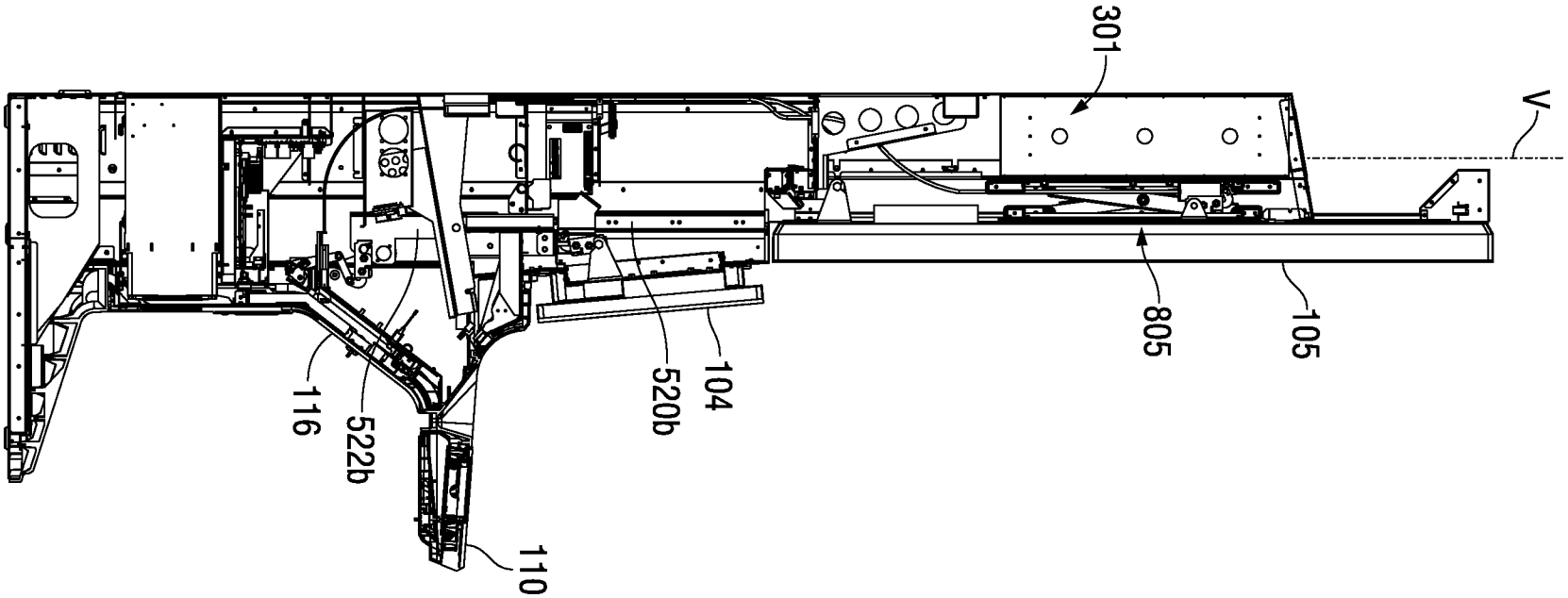
FIG. 4 is a section view in the direction of arrows 4-4 in FIG. 1.

FIG. 4 is a view in section similar to FIG. 3 but from the opposite direction. As will be described further below in connection with FIGS. 5-8, certain components of the cabinet opening mechanisms according to aspects of the invention are provided in pairs with the two components in each pair laterally spaced apart within the cabinet volume on opposite sides of the cabinet 101. Thus FIG. 3 shows components of the cabinet opening mechanisms on one side of the cabinet (the left side in the orientation of FIG. 1) while FIG. 4 shows components of the cabinet opening mechanisms on the opposite (right) side. Also, since the line along which the section views of FIGS. 3 and 4 are taken is slightly to the right of the vertical center of gaming machine 100 in FIG. 1, FIG. 3 shows certain components mounted in the center of gaming machine cabinet 101, while FIG. 4 does not show these center-mounted components. This will be discussed further in connection with the enlarged views of FIGS. 5-8.

Figure 5:
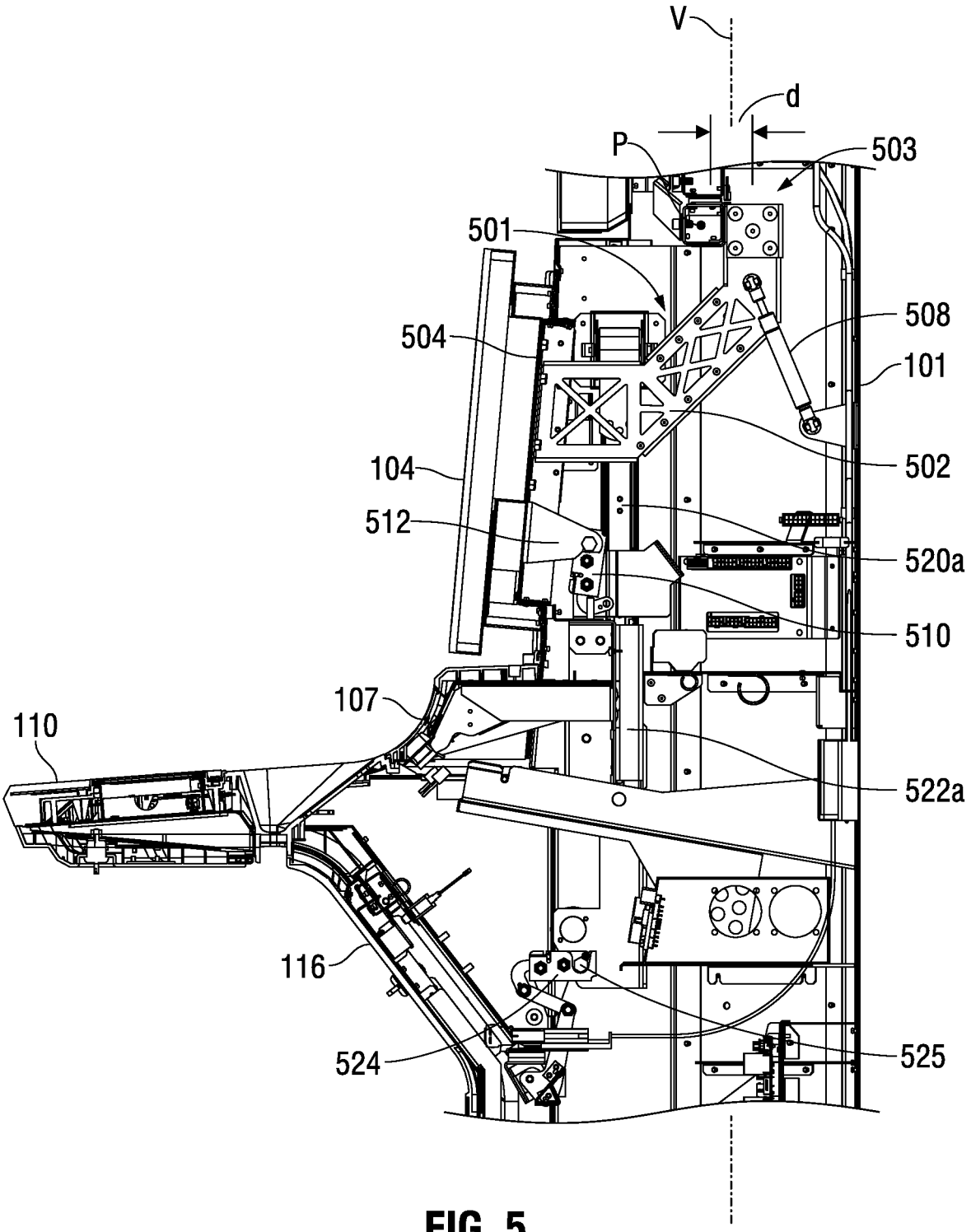
FIG. 5 is an enlarged section view of a central portion of the gaming machine shown in FIG. 1 in the direction of arrows 3-3 in FIG. 1.

Referring to the enlarged section view of FIG. 5 (and with reference to FIGS. 1 and 2), in its operating position first video display monitor 104 registers with and covers the upper portion of the base area of the cabinet front opening (the base area defined by opening 202 in FIG. 2). In particular, and as best shown in FIGS. 1 and 2, first video display monitor 104 extends laterally across and covers the entire width dimension of the upper portion of opening 202 when the first video display monitor is in its operating position. These same views show that in its operating position panel 107 registers with and covers the lower portion of the base area of the cabinet front opening. That is, panel 107 is shown as extending laterally across and covering the entire width dimension of the lower part of opening 202. As is apparent from FIGS. 1-4, second video display monitor 105 in its operating position registers with and covers the crown area defined by opening 203 shown in FIG. 2.

Figure 6:
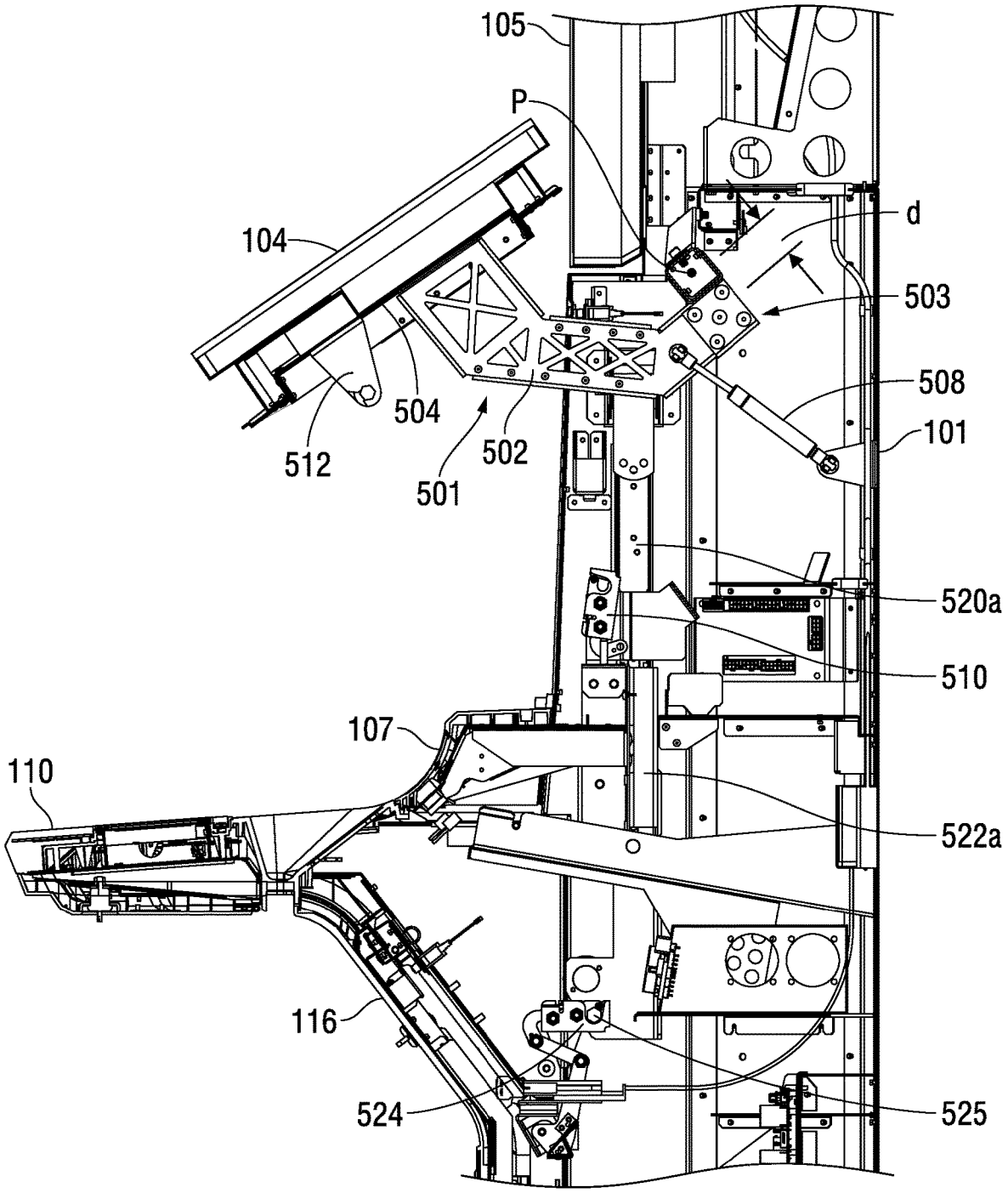
FIG. 6 is a section view similar to FIG. 5, but showing a first video monitor in an open position.
Figure 7:
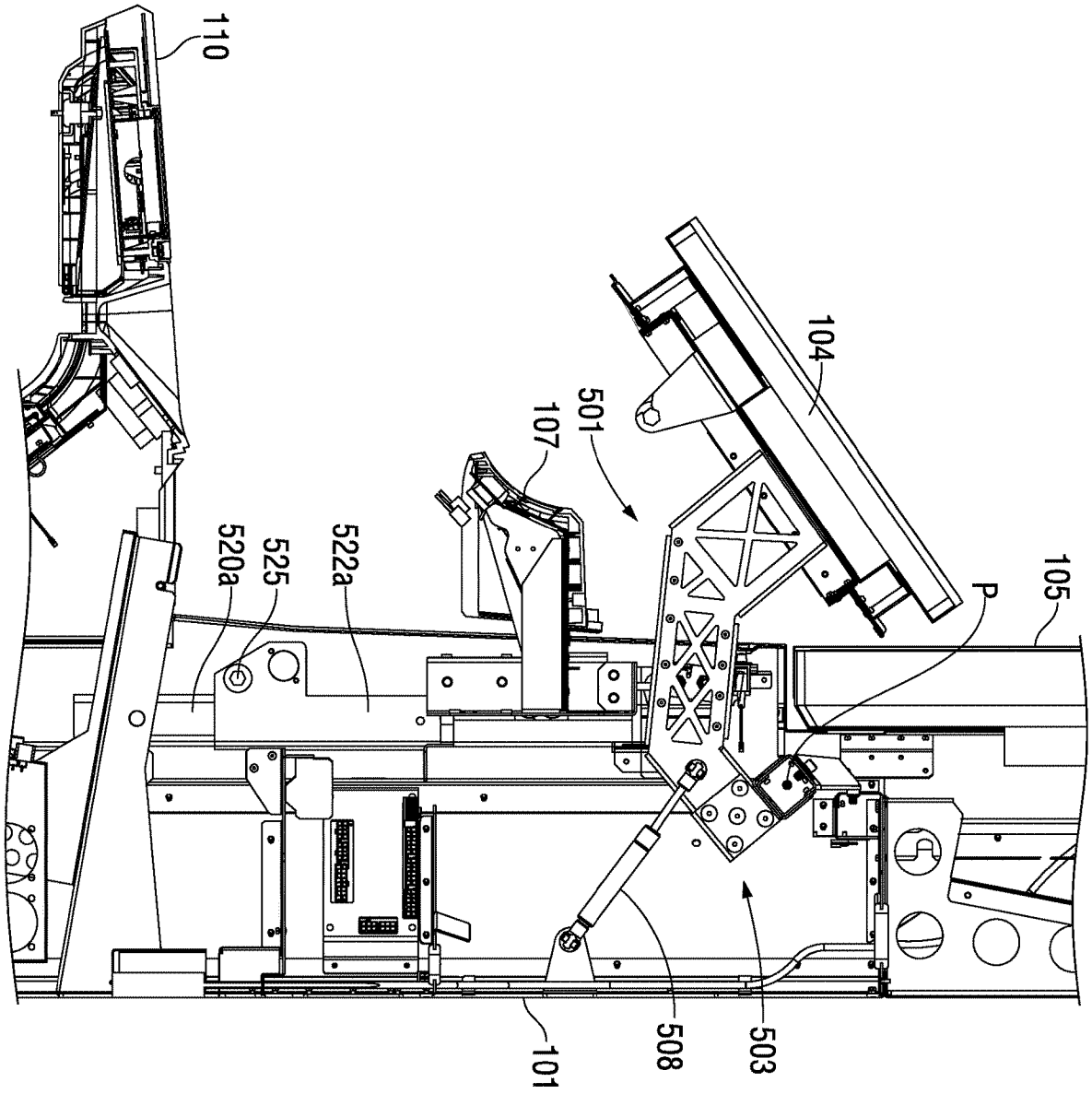
FIG. 7 is a section view similar to FIG. 5, but showing a panel component in an open position.

As shown best in FIGS. 5-7, first video display monitor 104 is mounted on a first extension assembly shown generally at 501 in the figures. First extension assembly 501 includes a pivot arm 502 with a monitor mounting bracket 504 located at a distal end of the pivot arm. First video display monitor 104 in this example configuration is connected to the first extension assembly via monitor mounting bracket 504. A proximal end 503 of pivot arm 502 is pivotally connected to gaming machine cabinet 101 so as to be pivotable about axis P which extends perpendicular to the plane of the drawing sheet in FIG. 5 and also perpendicular to a central vertical axis of the gaming machine cabinet shown in the figures as axis V.

In the example shown in the figures, a hydraulic or pneumatic damper 508 is connected between pivot arm 502 and gaming machine cabinet 101 to help support the weight of first video monitor 104 and extension assembly 501 when the first video monitor is moved to its open position as will be described further below. Although not shown in the drawings, spring devices such as constant force springs may be included in the pivot connection between pivot arm 502 and gaming machine cabinet 101 to also help support the weight of first video monitor 104 and extension assembly 501 when the first video monitor is moved to its open position.

In this particular example gaming machine shown in FIG. 5, a first video monitor latching mechanism 510 is included to securely latch the first video monitor 104 in the operating position shown in FIG. 5. Latching mechanism 510 is operable to catch and retain a catch feature which is included on monitor bracket 504 in this embodiment. In the view of FIG. 5, the catch feature extends on the opposite side of tab 512 and is thus not visible in this view. First video monitor latching mechanism 510 is associated with a release mechanism (not shown) which may be operated to cause the latching mechanism to release the catch feature on tab 512 and thus release the secure connection of first video display monitor 104 in the operating position shown in FIG. 5. An operator control to this release mechanism may be accessible through an opening into the gaming machine cabinet interior volume covered by lower panel 116.

Referring still to FIG. 5, panel 107 is connected to gaming machine cabinet 101 through a slide assembly. The slide assembly in this embodiment includes a first side rail 520*a* mounted substantially vertically on a first side of the gaming machine cabinet within the upper cabinet volume. This first side rail 520*a* is also visible in the view of FIG. 2. As shown in the section view of FIG. 4, a second side rail 520*b* is mounted substantially vertically on a second side of the gaming machine cabinet within the upper cabinet volume. The slide assembly further includes a carriage assembly connected to both the first side rail 520*a* and the second side rail 520*b* for longitudinal movement with respect to each rail. The illustrated carriage assembly includes a first side carriage 522*a* shown in FIG. 5 (also shown in FIG. 2), and a second side carriage 522*b* visible in FIG. 4. In some forms of the apparatus according to aspects of the invention, the carriage assembly can comprise a single element that extends the width of the cabinet interior volume and connects at each end to a respective side rail. In these implementations the panel 107 is mounted on this single carriage assembly component to facilitate the sliding movement described below. This single carriage structure is in contrast to the two separate carriage assembly components (first side carriage 522*a* and 522*b*) indicated by the present figures. In these separate carriage device implementations, panel 107 is connected at one end to first side carriage 522*a* at one side of the cabinet and to second side carriage 522*b* at the other side of the cabinet.

Implementations of the invention are not limited to any particular slidable connection between the carriage assembly, either the single component versions or the illustrated multiple component versions, and the two side rails to facilitate the desired longitudinal movement along the rails.

Some implementations may include suitable rollers mounted on the carriage assembly on either side of the rail and cooperating with the rail to provide smooth longitudinal movement along the rail. In other implementations, each rail may comprise a cylindrically shaped element and the carriage assembly may include a cylindrically shaped bushing or other element received on the respective cylindrically shaped rail so as to facilitate the desired movement along the rails.

FIG. 5 also shows a carriage latching mechanism 524 positioned and adapted to cooperate with a feature 525 at a lower end of first side carriage 522*a* to securely latch the first side carriage in the position shown in FIG. 5 in which panel 107 is in its operating position. A release mechanism (not shown) is associated with latching mechanism 524 to allow an operator to release the feature 525 and allow the carriage 522*a* and panel 107 to be raised to its open position as will be described below. As with the release associated with monitor latching mechanism 510, the carriage latch release mechanism is preferably accessible though the opening of the gaming machine covered by panel 116 in the lower portion of the gaming machine. Also, it will be appreciated that where the carriage assembly includes separate first and second side carriages, a latching mechanism may be associated with the carriage on each side of the gaming machine cabinet.

FIG. 6 shows first video display monitor 104 in an open position. To reach this position, first monitor latching mechanism 510 has been released to release the catch feature on tab 512, and an operator has pulled outwardly at the lower part of the video display monitor 104 to rotate pivot arm 502 clockwise about pivot axis P. As can be seen from FIG. 6, this movement of the video display monitor 104 to its open position removes the monitor from the upper part of the base area but remains supported on the gaming machine cabinet via pivot arm 502. Hydraulic or pneumatic damper 508 may provide support for the first video display monitor and pivot arm assembly in the open position shown in FIG. 6.

Pivot arm 502 includes an offset between the proximal end portion secured at pivot axis P and the remainder of the proximal end 503. This offset is shown at "d" in FIGS. 5 and 6. Also, pivot arm 502 includes a series of straight segments that combine to produce an overall concave curvature facing forward and upward in the orientation of FIG. 5 and upward in the orientation of FIG. 6. This curvature and the offset d both facilitate a greater range of movement for first video display monitor 104 about pivot axis P.

It should be noted from FIG. 6 that panel 107 remains supported in its operating position while first video display monitor 104 is moved to its open position. Once first video display monitor 104 is moved to the open position shown in FIG. 6, thus vacating the upper portion of the base area, panel 107 may be released from its operating position shown best in FIGS. 5 and 6 and moved upwardly on the carriage assembly including carriage 422*a* and the cooperating carriage 522*b* (shown in FIG. 4) ultimately to the panel open position shown in FIG. 7. As is apparent by comparing FIGS. 6 and 7, in the course of moving from the panel operating position shown in FIG. 6 to the panel open position shown in FIG. 7, panel 107 traverses at least some of the upper portion of the base area which was vacated by first video display monitor 104 when the display monitor was moved to its open position. Once the service or maintenance is complete, gaming machine 100 may be closed by first returning panel 107 to its operating position shown in FIGS. 5 and 6, and then returning first video monitor 104 to its operating position shown in FIG. 5. In each case the latching mechanism, 510 and 524, respectively, is preferably configured to automatically latch the respective catch feature to hold the video monitor 104 and panel 107 in the respective operating position.

As noted above, the illustrated form of the apparatus includes a single pivot arm 502 mounted at or near a vertical centerline of cabinet 101. Other implementations of the invention may include two pivot arms similar to arm 502, with the two arms laterally spaced apart on each side of the gaming machine.

Figure 8:
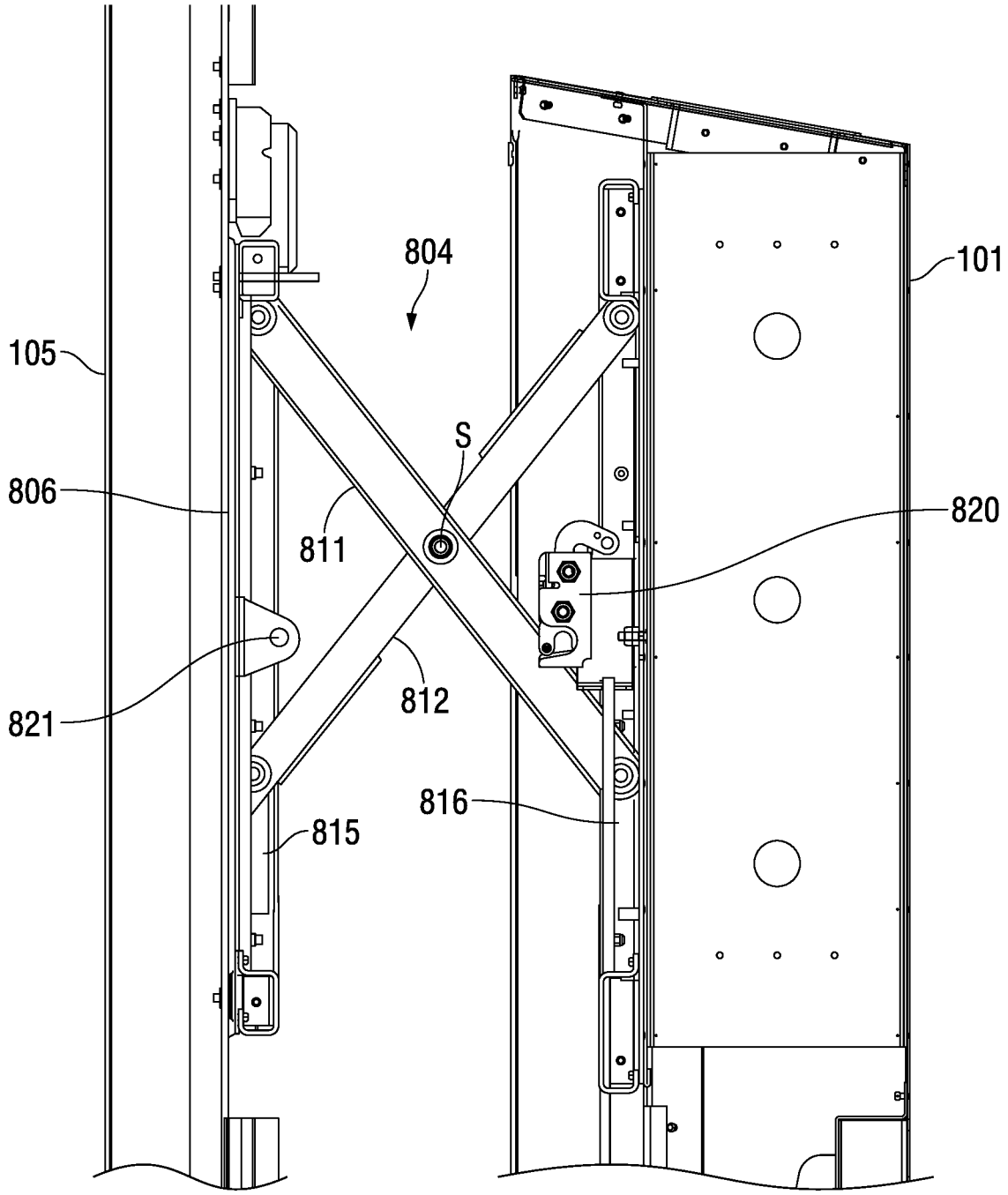
FIG. 8 is an enlarged section view of an upper portion of the gaming machine shown in FIG. 1 in the direction of arrows 3-3 in FIG. 1, but showing a second video monitor in an open position.

In example gaming machine 100, second video display monitor 105 is also mounted on the gaming machine cabinet 101 so that it may be moved to a respective open position to expose the crown area of the cabinet interior volume defined by opening 203 (shown in FIG. 2). Referring to the enlarged view of FIG. 8, gaming machine 100 includes a second extension assembly connected between second video monitor 105 and gaming machine cabinet 101. In this implementation, and referring also to FIG. 2 which shows the monitor 105 removed from cabinet 101, and to FIG. 4 which shows the opposite side of the cabinet 101, the second extension assembly includes a scissor mechanism having first and second side scissor mechanisms 804 and 805, respectively, connected to second monitor mounting bracket 806. Referring now to FIG. 8, scissor mechanism 804 includes a first elongated member 811 and a second elongated member 812 connected at a pivot point S. The upper end of first member 811 is rotatably connected to an upper part of monitor mounting bracket 806 while an upper end of second member 812 is rotatably connected to cabinet 101 within the interior volume of the gaming machine. A lower end of first member 811 is connected to a slot 815 on bracket 806 while a lower end of second member 812 is mounted in a slot 816 formed on an element connected to the gaming machine cabinet 101. Scissor mechanism 805 at the opposite side of cabinet 101 from mechanism scissor mechanism 804 includes a similar structure although the various components are not numbered in FIGS. 2 and 4 due to the scale of those figures. An upper monitor latching arrangement is included to secure the second video display monitor in the operating position shown in FIGS. 1, 3, and 4. This latching arrangement includes upper monitor latch mechanism 820 which cooperates with a catch pin 821 mounted on the monitor mounting bracket 806. In the operating position of video display monitor 105 shown particularly in FIGS. 3 and 4, latch pin 821 is received in latch mechanism 820 to retain the monitor in the desired operating position. Latch mechanism 820 is associated with a release (not shown) that allows pin 821 to be released to allow second video display monitor 105 to move on the scissor mechanisms 804 and 805 from the operating position shown in FIGS. 1, 3, and 4 to the open position shown in FIG. 8. The release mechanism for latching mechanism 820 is preferably operable from a point in the bottom part of the gaming machine interior volume accessible through the opening covered by panel 116.

As used herein, whether in the above description or the following claims, the terms "comprising," "including," "carrying," "having," "containing," "involving," and the like are to be understood to be open-ended, that is, to mean including but not limited to. Also, it should be understood that the terms "about," "substantially," and like terms used herein when referring to a dimension or characteristic of a component indicate that the described dimension/characteristic is not a strict boundary or parameter and does not exclude variations therefrom that are functionally similar. At a minimum, such references that include a numerical parameter would include variations that, using mathematical and industrial principles accepted in the art (e.g., rounding, measurement or other systematic errors, manufacturing tolerances, etc.), would not vary the least significant digit.

Any use of ordinal terms such as "first," "second," "third," etc., in the following claims to modify a claim element does not by itself connote any priority, precedence, or order of one claim element over another, or the temporal order in which acts of a method are performed. Rather, unless specifically stated otherwise, such ordinal terms are used merely as labels to distinguish one claim element having a certain name from another element having a same name (but for use of the ordinal term).

The term "each" may be used in the following claims for convenience in describing characteristics or features of multiple elements, and any such use of the term "each" is in the inclusive sense unless specifically stated otherwise. For example, if a claim defines two or more elements as "each" having a characteristic or feature, the use of the term "each" is not intended to exclude from the claim scope a situation having a third one of the elements which does not have the defined characteristic or feature.

The above described preferred embodiments are intended to illustrate the principles of the invention, but not to limit the scope of the invention. Various other embodiments and modifications to these preferred embodiments may be made by those skilled in the art without departing from the scope of the present invention. For example, in some instances, one or more features disclosed in connection with one embodiment can be used alone or in combination with one or more features of one or more other embodiments. More generally, the various features described herein may be used in any working combination.

The invention claimed is:

1. A gaming machine including:

(a) a gaming machine cabinet defining an upper cabinet volume above a level of a button deck mounted on the gaming machine cabinet, and a cabinet front opening to the upper cabinet volume;

(b) a first gaming machine element mounted on the gaming machine cabinet;

(c) a first extension assembly connected between the first gaming machine element and the gaming machine cabinet, the first extension assembly operable for enabling the first gaming machine element to be moved from a first element operating position in which the first gaming machine element registers with and covers an upper portion of a base area of the cabinet front opening so as to extend across the entire width dimension of the upper portion of the base area, to a first element open position in which the first gaming machine element remains supported by the gaming machine cabinet and is removed from the upper portion of the base area;

(d) a panel component mounted on the gaming machine cabinet; and (e) a slide assembly connected between the panel component and the gaming machine cabinet, the slide assembly operable for, when the first gaming machine element is in the first element open position, enabling the panel component to be moved from a panel component operating position registering with and covering a lower portion of the base area so as to extend across the entire width dimension of the lower portion of the base area to a panel open position in which the panel component remains supported by the gaming machine cabinet, the panel component, when moved from the panel component operating position to the panel open position, traversing at least some of the upper portion of the base area from which the first gaming machine element is removed when moved to the first element open position.

2. The gaming machine of claim 1 wherein the first extension assembly includes a pivot arm connected at a distal end thereof to the first gaming machine element, the pivot arm having a proximal end pivotally connected to the gaming machine cabinet to facilitate rotation of the pivot arm about a pivot axis extending perpendicular to a vertical axis of the gaming machine cabinet as the first gaming machine element is moved from the first element operating position to the first element open position.

3. The gaming machine of claim 2 wherein the pivot axis is located within the upper cabinet volume between the cabinet front opening and a rear wall of the gaming machine cabinet.

4. The gaming machine of claim 2 wherein the pivot arm includes an extension part at the proximal end thereof, and is pivotally connected to the gaming machine cabinet in the extension part so that the pivot axis is offset from a longitudinal axis at the proximal end of the pivot arm.

5. The gaming machine of claim 4 wherein the pivot arm forms a concave shape that faces forward within the upper cabinet volume when the first gaming machine element is in the first element operating position.

6. The gaming machine of claim 1 wherein the slide assembly includes:

(a) a first side rail mounted substantially vertically on a first side of the gaming machine cabinet within the upper cabinet volume, and a second side rail mounted substantially vertically on a second side of the gaming machine cabinet within the upper cabinet volume;

(b) a carriage assembly connected to both the first side rail and the second side rail for longitudinal movement with respect to each rail; and (c) wherein the panel component is mounted on the carriage assembly.

7. The gaming machine of claim 6 wherein:

(a) the carriage assembly includes a first side carriage connected to the first side rail for movement with respect to the first side rail along a longitudinal axis thereof and a second side carriage connected to the second side rail for movement with respect to the second side rail along a longitudinal axis thereof; and (b) wherein the panel component is mounted at a first end thereof on the first side carriage and mounted at second end thereof of the second side carriage.

8. The gaming machine of claim 1 wherein the first gaming machine element is a first video monitor of the gaming machine.

9. The gaming machine of claim 1 wherein the panel component is an elongated structure on which is mounted one or more player interface devices.

10. The gaming machine of claim 1 further including:

(a) a second gaming machine element mounted on the gaming machine cabinet; and (b) a second extension assembly connected between the second gaming machine element and the gaming machine cabinet, the second extension assembly operable enable the second gaming machine element to be moved from a second element operating position in which the second gaming machine element registers with and covers a crown area of the cabinet front opening located above the base area, to a second element open position in which the second gaming machine element remains supported by the gaming machine cabinet and is removed from the crown area.

11. The gaming machine of claim 10 wherein the second extension assembly includes:

(a) a first side scissor mechanism connected at a distal end thereof to the second gaming machine element and connected at a proximal end thereof to the gaming machine cabinet within the cabinet upper volume; and (b) a second side scissor mechanism connected at a distal end thereof to the second gaming machine element and connected at a proximal end thereof to the gaming machine cabinet within the cabinet upper volume, the first side scissor mechanism and second side scissor mechanism being spaced apart about a center vertical axis of the gaming machine cabinet.

12. The gaming machine of claim 11 wherein the second gaming machine element is a second video monitor.

13. A method for opening a gaming machine cabinet which defines an upper cabinet volume above a level of a button deck mounted on the gaming machine cabinet, and a cabinet front opening to the upper cabinet volume, the method including:

(a) moving a first gaming machine element supported by the gaming machine cabinet from a first element operating position in which the first gaming machine element registers with and covers an upper portion of a base area of the cabinet front opening so as to extend across the entire width dimension of the upper portion of the base area, to a first element open position in which the first gaming machine element remains supported by the gaming machine cabinet and is removed from the upper portion of the base area;

(b) when the first gaming machine element is in the first element open position, moving a panel component which is supported by the gaming machine cabinet from a panel component operating position registering with and covering a lower portion of the base area so as to extend across the entire width dimension of the lower portion of the base area to an panel open position in which the panel component remains supported by the gaming machine cabinet, the panel component, when moved from the panel component operating position to the panel open position, traversing at least some of the upper portion of the base area from which the first gaming machine element is removed when moved to the first element open position; and (c) wherein when the first gaming machine element is in the first element open position and the panel component is in the panel open position, the lower portion of the base area and at least some of the upper portion of the base area is exposed so as to provide access to the upper cabinet volume.

14. The method of claim 13 wherein moving the first gaming machine element from the first element operating position to the first element open position includes pivoting the first gaming machine element on a pivot arm having a proximal end pivotally connected to the gaming machine cabinet to facilitate rotation of the pivot arm about a pivot axis extending perpendicular to a vertical axis of the gaming machine cabinet.

15. The method of claim 14 wherein the pivot axis is located within the upper cabinet volume between the cabinet front opening and a rear wall of the gaming machine cabinet.

16. The method of claim 14 wherein the pivot arm forms a concave shape that faces forward within the upper cabinet volume when the first gaming machine element is in the first element operating position.

17. The method of claim 13 wherein moving the panel component from the panel component operating position to the panel open position includes sliding the panel component along first and second side rails spaced apart within the upper cabinet volume.

18. The method of claim 17 wherein the panel component is connected to the first and second side rail through a carriage assembly and wherein sliding the panel component along the first and second side rail includes sliding the carriage assembly along the first and second side rails.

19. The method of claim 13 wherein the first gaming machine element is a first video monitor.

20. The method of claim 13 wherein the panel component is an elongated structure on which is mounted one or more player interface devices.

* * * * *